US005813428A

United States Patent [19]

Almasy et al.

[11] Patent Number: 5,813,428

[45] Date of Patent: Sep. 29, 1998

[54] COMBINATION WALL HYDRANT AND BACKFLOW PREVENTOR

[75] Inventors: Lawrence Almasy; James F. Shuler; Robert J. Vandepas, all of Colorado Springs, Colo.

[73] Assignee: WCM Industries, Inc., Colorado Springs, Colo.

[21] Appl. No.: 648,622

[22] Filed: May 16, 1996

[51] Int. Cl.[6] ..... E03C 1/10

[52] U.S. Cl. ..... 137/218; 137/798; 285/392; 285/915

[58] Field of Search ..... 137/218, 798; 285/392, 915

[56] References Cited

U.S. PATENT DOCUMENTS

| | | | |
|---|---|---|---|
| 2,997,054 | 8/1961 | Woodford | 137/218 |
| 3,023,767 | 3/1962 | Woodford | 137/218 |
| 3,146,142 | 8/1964 | Maly | 285/915 X |
| 3,414,001 | 12/1968 | Woodford | 137/798 X |
| 3,543,786 | 12/1970 | Woodford | 137/218 |
| 4,117,856 | 10/1978 | Carlson | 137/218 |
| 4,821,763 | 4/1989 | Ackroyd et al. | 137/218 |
| 5,195,785 | 3/1993 | Jellison | 285/392 X |

OTHER PUBLICATIONS

Model 27 Series Automatic Draining Freezeless Wall Faucets, Woodford Meg. Co., Brochure Dated 1990.

*Primary Examiner*—Gerald A. Michalsky

*Attorney, Agent, or Firm*—Zarley, McKee, Thomte, Voorhees & Sease

[57] ABSTRACT

A fluid hydrant has an outlet with a threaded outer surface, and a backflow preventor is mounted on the inlet of the hydrant. The backflow preventor has an inlet and outlet end. Male hose threads are formed on the exterior of the outlet end of the backflow preventer. Interior female threads are on the inlet end thereof. A bushing adapter is interposed between the inlet end of the backflow preventor and the threaded nozzle of the hydrant with the threads connecting the adapter and the backflow preventor being of a size different than the threads connecting the adapter and the threaded nozzle of the hydrant. The bushing adapter extends over the threaded outer surface of the outlet of the hydrant, and a locking cement between the threaded outer surface of the outlet of the hydrant and the interior female threads on the inlet end of the bushing adapter rigidly fix these threads together. The method permanently affixing a backflow preventor to the threaded outer surface of a hydrant comprises taking a backflow preventor having an inlet end with a threaded interior; threading an adapter between the inlet end of the backflow preventor and the threaded outlet of the hydrant; providing different thread sizes at the interior and exterior surfaces of the adapter, with the threads at the interior surface being compatible with the threads of the nozzle on the hydrant; and placing a locking adhesive between the interior threads of the adapter and the nozzle threads of the hydrant.

12 Claims, 3 Drawing Sheets

10
12
14
16
18
20
22
24
26
28
30
32
34
35
36
38
40
48
52
56
3
3

COMBINATION WALL HYDRANT AND BACKFLOW PREVENTOR

BACKGROUND OF THE INVENTION

With the development of a double check backflow preventor for installation on hose threaded outlets, several functional attributes must be present as required by common sense principles, or in some cases, code requirements. First of all, the double check backflow preventor must have a frost resistant draining feature. It must be capable of being field tested. Further, it must be non-removable from the threaded outlet of the hydrant, and it must fit all hose threaded outlets. Many of the faucets or hydrants on the market have widely varying lengths of male outlet threads which complicates the fulfillment of the above described requirements. These various thread lengths of existing faucets adversely impact the ability to design a cost effective device that incorporates all of the necessary features.

It is therefore a principal object of this invention to provide a combination hydrant and backflow preventor which has a frost resistant draining feature.

A further object of this invention is to provide a combination hydrant and double check backflow preventor which can be field tested.

A still further object of this invention is to have a combination hydrant and backflow preventor wherein the backflow preventor cannot be removed from the hydrant.

A still further object of this invention is to have a double check backflow preventor with a female threaded inlet that will fit all hose threaded outlets of existing faucets or hydrants.

These and other objects will be apparent to those skilled in the art.

SUMMARY OF THE INVENTION

A fluid hydrant has an outlet with a threaded outer surface, and a backflow preventor is mounted on the inlet of the hydrant. The backflow preventor has a hollow body member having an inlet and outlet end. A fluid backflow preventor assembly is in the body member to permit fluid flow through the body member towards the outlet end. Male threads are formed on the exterior of the outlet end of the body member for threadable insertion into female threads on a hose. Interior female threads are on the inlet end of the body member. A bushing adapter is interposed between the inlet end of the backflow preventor and the threaded nozzle of the hydrant with the threads connecting the adapter and the backflow preventor being of a size different than the threads connecting the adapter and the threaded nozzle of the hydrant. The bushing adapter extends over the threaded outer surface of the outlet of the hydrant, and a locking cement between the threaded outer surface of the outlet of the hydrant and the interior female threads on the inlet end of the bushing adapter rigidly fix these threads together.

The method of permanently affixing a backflow preventor to the threaded outer surface of a hydrant comprises taking a backflow preventor having an inlet end with a threaded interior; threadably placing an adapter between the inlet end of the backflow preventor and the threaded outlet of the hydrant; providing different thread sizes at the interior and exterior surfaces of the adapter, with the threads at the interior surfaces being compatible with the threads of the nozzle on the hydrant; and placing a locking adhesive between the interior threads of the adapter and the nozzle threads of the hydrant.

DESCRIPTION OF THE PREFERRED EMBODIMENT

Figures 1, 2, 3:
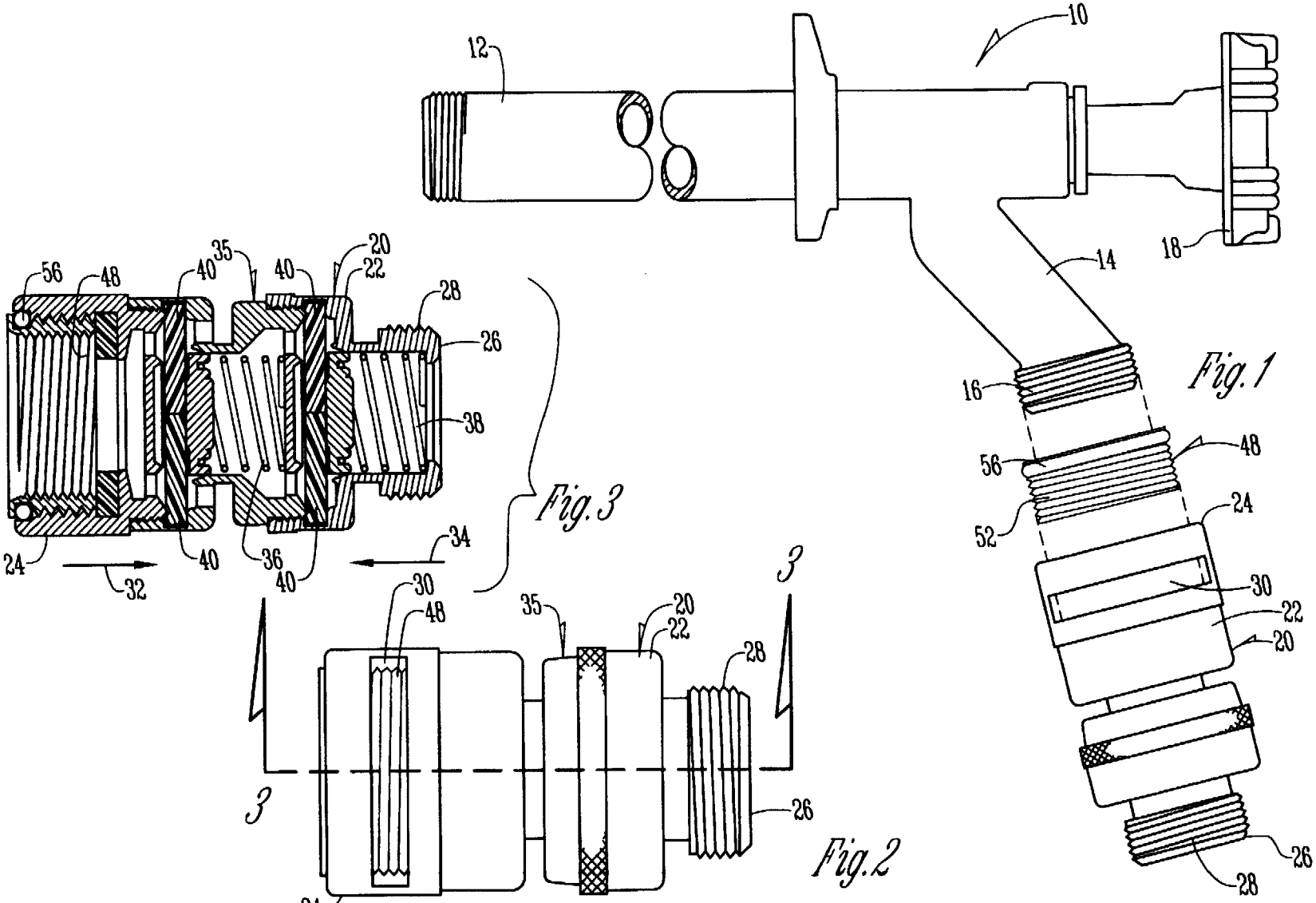
FIG. 1 is an exploded side elevational view of the preferred embodiment of this invention.
FIG. 2 is a longitudinal sectional view at an enlarged scale elevational view of the backflow preventor of this invention.
FIG. 3 is a sectional view of the backflow preventor taken on line 3—3 of FIG. 1.

With reference to FIG. 1, a conventional wall hydrant 10 has a inlet end 12 and a threaded nozzle outlet 14. The threads on nozzle 14 are designated by the numeral 16. A conventional valve control handle 18 extends outwardly from hydrant or faucet 10 and its rotation in one direction closes fluid flow, and rotation in the other direction opens the hydrant or faucet 10 to fluid flow through nozzle 14. This construction is conventional and does not of itself entail the essence of this invention.

A double check valve backflow preventor 20 has a hollow body member 22, an inlet end 24 and an outlet end 26. The outlet end is threaded at 28 with threads of the same size as threads 16 on nozzle 14. The threads 16 and 28 are hose threads adapted to receive a common garden hose. Body member 22 has a drain slot 30 which will be discussed hereafter. With reference to FIG. 3, arrow 32 designates the direction of fluid flow under normal conditions. Arrow 34 designates the direction of attempted fluid flow under adverse conditions when fluid attempts to flow inwardly into the hydrant 10.

The backflow preventor 20 does not of itself constitute the essence of this invention insofar as its backflow preventor assembly 35 is concerned. With reference to FIG. 3, assembly 35 includes springs 36 and 38 which function in connection with pairs of split diaphragms 40. The diaphragms 40 at their center portions will each bend to the right as viewed in FIG. 3 under normal flow conditions. Under adverse reverse flow conditions (arrow 34) the pairs of diaphragms 40 will assume their closed non-reverse flow position as shown in FIG. 3. Again, the structure of backflow preventor assembly 35 does not of itself constitute the essence of this invention.

Figure 4:
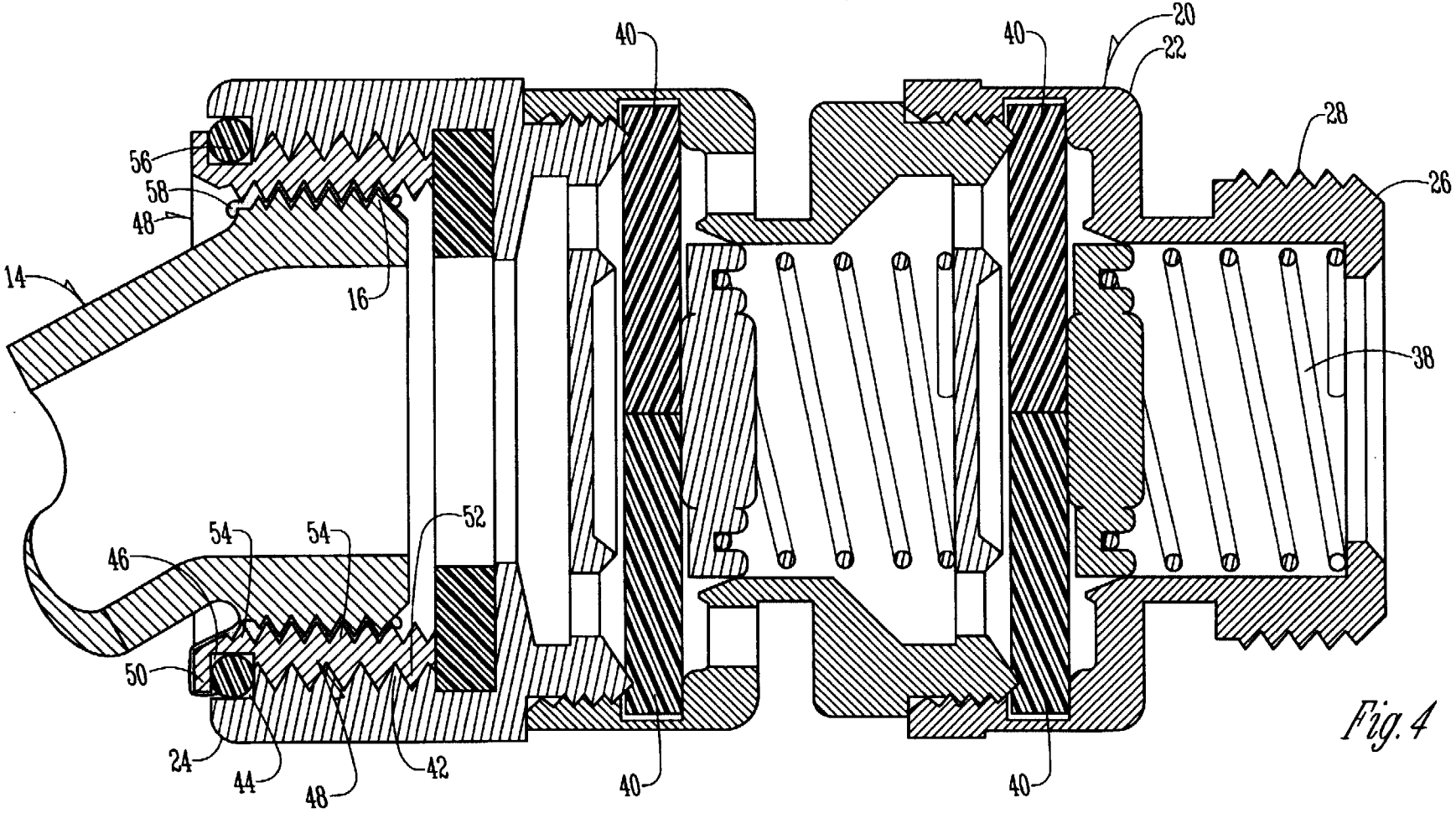
FIG. 4 is an enlarged scale sectional view of the backflow preventor of this invention mounted on the threaded nozzle of a fluid hydrant.

As best shown in FIG. 4, interior threads 42 are formed at the inlet end of body member 22. An annular groove 44 is formed at the inlet end 24 of the body member and registers with an annular groove 46 in bushing 48. The two annular grooves 44 and 46 combine to form an enclosed annular groove to be discussed hereafter. Bushing 48 has a radially extending flange 50 which serves to close the combined annular groove of grooves 46 and 48. Bushing 48 has exterior threads 52 which mate with the interior threads 42 on the body member 22. Interior threads 54 within bushing 48 are hose threads and are adapted to simulate the hose threads 16 on nozzle 14.

An O-ring or seal 56 is located in the combined annular groove formed by grooves 44 and 48. The flange 50 and the O-ring 56 serve to prevent any of the adhesive 58 between threads 16 of nozzle 14 and the interior threads 54 of bushing 48 from entering between threads 52 of bushing 48 and the interior threads 42 of body 22.

The adhesive 58 is preferably LOCTITE® RC/680 made by Loctite Corporation of Newington, Conn. Adhesive 58 is a single component room temperature curing compound used for high strength bonding and sealing of cylindrical parts. It is recommended for temperatures up to 300 degrees F. where clearances do not exceed 0.15 inches diametral. Adhesive 58 will cure in approximately 15 minutes as used between the threads 16 and 54.

Figure 5:
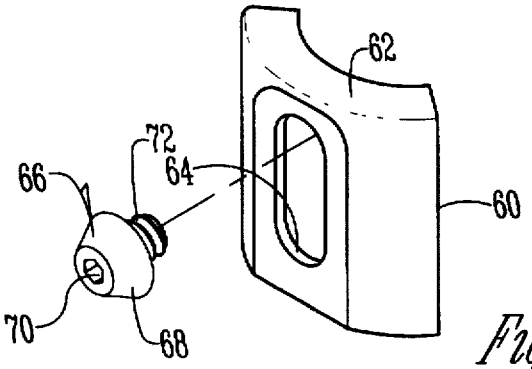
FIG. 5 is an enlarged perspective view of a collar attachment that prevents the removal of the backflow preventor from the bushing on the inlet end thereof.
Figure 6:
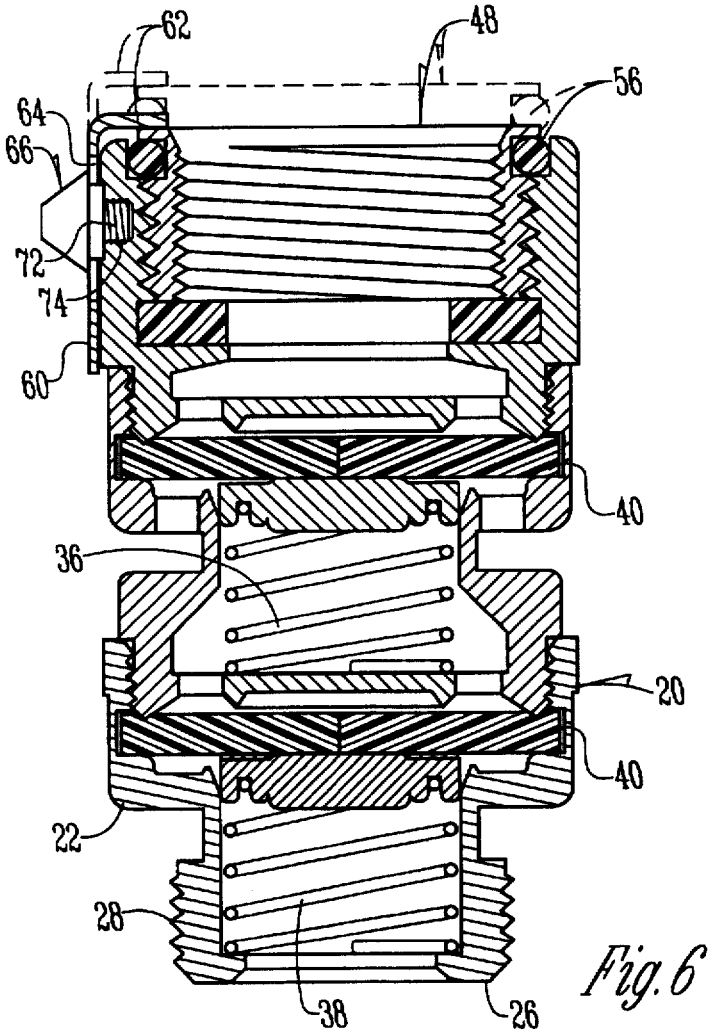
FIG. 6 is a longitudinal sectional view similar to that of FIG. 3 but shows the collar attachment of FIG. 5 in place.

With reference to FIG. 5, a collar element 60 is of curved construction and has a flange 62 which extends radially inwardly. A longitudinal slot 64 is formed in collar element 60. A screw 66 having a tapered head 68 has an Allen wrench slot 70 therein adapted to receive a non-typically sized Allen wrench. Screw 66 has a threaded shank 72 which is threadably inserted in threaded bore 74 of body member 22 (FIG. 6). The bushing 48 is typically assembled within body member 22 as described above. The threads 16 of nozzle 14 of an existing hydrant are then cleaned to remove any dirt, grease, loose paint or loose corrosion. The adhesive 58 is then applied in a bead extending around threads 16 near the middle of the threads 16. The backflow preventor 20, through the interior threads 42 of bushing 48 are threaded clockwise onto the thread 16 only until the threads 16 are just covered. Any excess adhesive 58 is wiped away. It is important to note that the flange 50 and the O-ring 56 prevent any excessive adhesive from entering into the thread line between threads 42 and 52. After this is done, the backflow preventor 20 is not disturbed and water is not permitted to flow through the hydrant for at least 15 minutes.

During normal usage, the backflow preventor 20 must be turned clockwise to the seated position of FIG. 3. The hydrant 10 may be operated with or without a hose attached. When the backflow preventor 20 is installed on a frost-proof faucet and freezing temperatures occur, flow of water through the hydrant should be stopped by operating handle 18 and the backflow preventor is then turned counter-clockwise until it starts draining whereupon water in the hydrant will leave the hydrant through drain slot 30. After the hydrant has so drained, the backflow preventor 20 is then turned clockwise back to the seated position of FIG. 3.

Even though the threads 16 of nozzle 14 may be damaged or in some way deteriorated, the adhesive 58 will permit the interior threads 42 of bushing 48 to be inserted thereover, and the two threads are then permanently connected by the adhesive 58. This gives the device of this invention great universal application to all hydrants having hose threads.

Even if the backflow preventor 20 is threadably detached from the exterior threads of bushing 48, the exterior threads 52 on the bushing are not adaptable for connection by a hose, so that a hose cannot be connected to these threads so as to invite the danger of reverse flow into the hydrant.

Theft of the backflow preventor is inhibited by the collar element 5 because the cooperative effort of the screw 68 and the flange 62 prevent the nozzle and the backflow preventor from being completely threadably disengaged. The tapered head 68 on screw 68 makes it difficult if not impossible to unscrew the threads 68 by grasping the head with a pair of pliers or the like.

From the foregoing, it is seen that this invention will accomplish all of its stated objectives.

What is claimed is:

1. A backflow preventor for faucets, comprising, a hollow body member having an inlet end and an outlet end, a fluid backflow preventor assembly in said body member to permit fluid flow through said body member towards said outlet end and to prevent fluid flow through said body member towards said inlet end, male threads on the exterior of said outlet end of said body member for threadable insertion into female threads of a hose, interior female threads in said inlet end of said body member, a cylindrical bushing adapter having opposite interior and exterior surfaces and being removably mounted within the inlet end of said body member, first threads on the exterior surface of said bushing adapter and being threadably compatible and threadably engaged with the interior female threads on said inlet end of said body member, second threads on the interior surface of said bushing adapter and having a thread size different than said first threads, a seal element is mounted on the inlet end of said body member adjacent an inlet end of said bushing adapter to seal the threadline formed by the threadable engagement of the interior female threads on the inlet end of said body member and said first threads on the exterior surface of said bushing adapter, said seal element being a resilient O-ring mounted in registering annular grooves in said body member and said bushing adapter.

2. The device of claim 1 wherein the said second threads on the interior surface of said bushing adapter are of a size threadably compatible with the male threads on the outlet end of said body member.

3. The device of claim 1 wherein an outwardly extending annular flange is on the inlet end of said bushing adapter to contain said O-ring in said registering annular grooves.

4. The device of claim 3 wherein a collar segment is mounted adjacent the inlet end of said body member and having a curved segment juxtapositioned on said body member with an inwardly extending flange extending partially over the inlet end of said body member to engage said bushing adapter to prevent the removal of said bushing adapter from said body member.

5. The device of claim 4 wherein said collar segment is secured to said body member by a screw element, said screw element having a round head with tapered side edges.

6. The device of claim 5 wherein said collar has an elongated longitudinal slot slidably embracing said screw element to permit said body member to be threadably moved with respect to said bushing adapter, said slot having a length to limit said threadable movement so as to prevent said body member and said bushing to be threadably disengaged.

7. The combination of a fluid hydrant having an outlet with a threaded outer surface, and a backflow preventor mounted on said inlet, comprising, said backflow preventor having a hollow body member having an inlet and an outlet end, a fluid backflow preventor assembly in said body member to permit fluid flow through said body member towards said outlet end and to prevent fluid flow through said body member towards said inlet end, male threads on the exterior of said outlet end of said body member for threadable insertion into female threads of a hose, interior female threads in said inlet end of said body member extending over the threaded outer surface of the outlet of said hydrant, and a cylindrical bushing adapter having opposite interior and exterior surfaces is removably mounted within the end of said body member, first threads on the exterior surface of said bushing adapter and being threadably compatible and threadably engaged with the interior female threads on said inlet end of said body member, second threads on the interior surface of said bushing adapter and having a thread size different than said first threads, a locking cement being located between the threaded outer surface of the outlet of said hydrant and the second threads on the interior surface of said bushing adapter, a resilient O-ring is mounted on the inlet end of said body member adjacent an inlet end of said bushing adapter to seal the threadline formed by the threadable engagement of the interior female threads on the inlet end of said body member and said first threads on the exterior surface of said bushing adapter, said resilient O-ring is mounted in registering annular grooves in said body member and said bushing adapter.

8. The combination of claim 7 wherein the said second threads on the interior surface of said bushing adapter are of a size threadably compatible with the male threads on the outlet end of said body member.

9. The combination of claim 7 wherein a collar segment is mounted adjacent the inlet end of said body member and having a curved segment juxtapositioned on said body member with an inwardly extending flange extending partially over the inlet end of said body member to engage said bushing adapter to prevent the removal of said bushing adapter from said body member.

10. The combination of claim 7 wherein a collar segment is secured to said body member by a screw element, said screw element having a round head with tapered side edges.

11. The combination of claim 10 wherein said collar has an elongated longitudinal slot slidably embracing said screw element to permit said body member to be threadably moved with respect to said bushing adapter, said slot having a length to limit said threadable movement so as to prevent said body member and said bushing to be threadably disengaged.

12. The combination of a fluid hydrant having an outlet with a threaded outer surface, and a backflow preventor mounted on said inlet, comprising, said backflow preventor having a hollow body member having an inlet and an outlet end, a fluid backflow preventor assembly in said body member to permit fluid flow through said body member towards said outlet end and to prevent fluid flow through said body member towards said inlet end, male threads on the exterior of said outlet end of said body member for threadable insertion into female threads of a hose, interior female threads in said inlet end of said body member extending over the threaded outer surface of the outlet of said hydrant, and a cylindrical bushing adapter having opposite interior and exterior surfaces is removably mounted within the end of said body member, first threads on the exterior surface of said bushing adapter and being threadably compatible and threadably engaged with the interior female threads on said inlet end of said body member, second threads on the interior surface of said bushing adapter and having a thread size different than said first threads, a locking cement being located between the threaded outer surface of the outlet of said hydrant and the second threads on the interior surface of said bushing adapter, a resilient O-ring is mounted on the inlet end of said body member adjacent an inlet end of said bushing adapter to seal the threadline formed by the threadable engagement of the interior female threads on the inlet end of said body member and said first threads on the exterior surface of said bushing adapter, an outwardly extending annular flange on the inlet end of said bushing adapter to contain said O-ring in registering annular grooves in said body member and said bushing adapter.

* * * * *

UNITED STATES PATENT AND TRADEMARK OFFICE

CERTIFICATE OF CORRECTION

PATENT NO. : 5,813,428

DATED : September 29, 1998

INVENTOR(S) : Lawrence Almasy; James F. Schuler; Robert J. Vandepas

It is certified that error appears in the above-identified patent and that said Letters Patent is hereby corrected as shown below:

Column 4, line 36, strike the numeral "3" and insert the numeral - 1 -.

Signed and Sealed this

Twenty-ninth Day of December, 1998

*Attest:*

Bruce Lehman

BRUCE LEHMAN

*Attesting Officer*

*Commissioner of Patents and Trademarks*